United States Patent [19]

Wayson

[11] 4,107,913

[45] Aug. 22, 1978

[54] AIR-COOLED TRAVELER

[75] Inventor: Andrew J. Wayson, Needham, Mass.

[73] Assignee: Litton Industrial Products, Inc., Hingham, Mass.

[21] Appl. No.: 700,665

[22] Filed: Jun. 28, 1976

Related U.S. Application Data

[63] Continuation of Ser. No. 547,723, Feb. 6, 1975, abandoned.

[51] Int. Cl.[2] ..... D01H 7/60

[52] U.S. Cl. ..... 57/125

[58] Field of Search ..... 57/125–126

[56] References Cited

U.S. PATENT DOCUMENTS

| | | | |
|---|---|---|---|
| 1,834,874 | 12/1931 | Schaaff | 57/126 |
| 2,112,710 | 3/1938 | Schaaff | 57/126 |
| 2,198,636 | 4/1940 | Schaaff | 57/125 X |
| 3,318,081 | 5/1967 | Wayson et al. | 57/125 |
| 3,621,645 | 11/1971 | Furst | 57/125 X |
| 3,664,113 | 5/1972 | Wayson | 57/125 |

*Primary Examiner*—Charles Gorenstein

*Attorney, Agent, or Firm*—Joseph R. Spalla

[57] ABSTRACT

A traveler for use on vertical textile yarn spinning or twisting rings. The traveler comprises two parts. A ring contacting part bears against the spinning ring as the traveler travels around the ring and a yarn contacting part engages the yarn as it passes from the feed rolls to the bobbin on which the spun yarn is wound. The ring contacting part is joined to the heat-conductive, yarn contacting part so that a substantial portion of its surface is exposed to the atmosphere. As the traveler spins around the ring, heat generated in the area where the yarn frictionally engages the yarn contacting part is conducted away from this area and is dissipated into the atmosphere due to the motion of the air past the exposed surface of the yarn contacting part. The yarn contacting area is thereby cooled.

7 Claims, 7 Drawing Figures

AIR-COOLED TRAVELER

This is a continuation of application Ser. No. 547,723 filed Feb. 6, 1975 now abandoned.

BACKGROUND

This invention relates to travelers for use on vertical textile spinning or twisting rings, and more particularly to two-part travelers.

Two-part travelers comprise a metallic, yarn engaging part embedded in a synthetic, ring engaging part. A two-part traveler combines the wear-resistant properties of a synthetic material such as nylon where the traveler contacts the metallic spinning ring with the desirable properties of a metal where the traveler frictionally engages the yarn being spun or twisted.

In prior art two-part travelers, such as that described in U.S. Pat. No. 3,318,081 to Wayson and Bucchianeri, the metallic, yarn engaging part is enclosed or "buried" in the synthetic part. As the yarn pulls the traveler around the ring, the friction between the yarn and the metallic part of the traveler generates heat. Since the synthetic material is typically a heat insulating material, heat is not readily dissipated, but is localized or trapped in the portion of the yarn engaging part above the heat insulating part. Heat is particularly localized or trapped in the area where the yarn engages the yarn engaging part.

One difficulty found particularly in the spinning or twisting of synthetic yarn, such as polyester yarn, is that the localized heat can be sufficient to heat glaze the fibers at the surface of the yarn. This can result in an undesirable intermittent glaze effect. When the yarn is dyed, the glaze will result in irregular coloring due to differences in dye acceptance by the yarn surface. Similarly, in spinning fibers which melt at low temperatures, such as polypropylene, the localized heat may be sufficient to heat distort the yarn, resulting in an undesirable product.

Accordingly, it is an object of the invention to dissipate the heat generated in the area where the yarn frictionally engages the traveler.

Other objects and many of the intended advantages of this invention will be readily appreciated as the same becomes better understood by reference to the following detailed description when considered in connection with the accompanying drawing in which like reference characters designate like parts and primed reference characters designate equivalent parts throughout the Figures thereof and wherein:

DETAILED DESCRIPTION OF THE DRAWING

Figure 1:
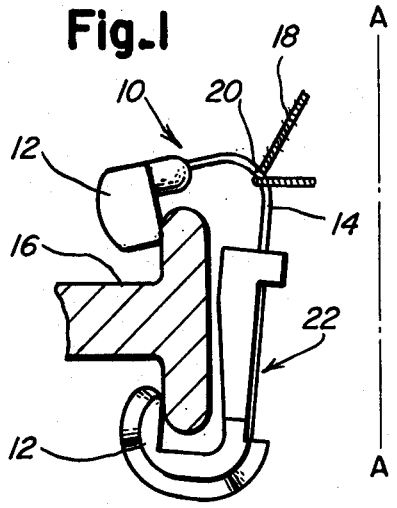
FIG. 1 is a cross-sectional view taken along line 1—1 of FIG. 2, showing a full side view of a traveler in accordance with the invention, in spinning position around a vertical spinning ring.

The air-cooled traveler of the invention, generally designated by the reference numeral 10 in the Figures of the Drawing comprises two parts, a textile spinning ring engaging part 12 and a textile yarn engaging part 14.

Figure 4:
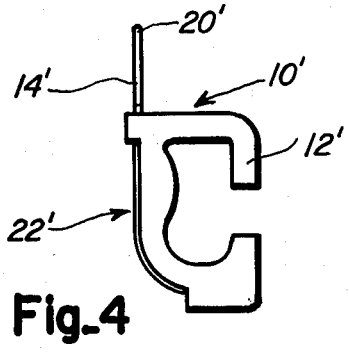
FIG. 4 is a side view of a traveler in accordance with the invention illustrating an additional embodiment of the invention.
Figure 5:
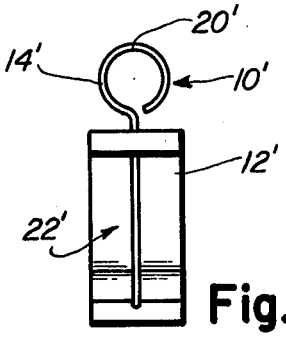
FIG. 5 is an end view of the embodiment of the invention illustrated in FIG. 4.

Ring engaging part 12 has a generally upright C-shape to fit around a conventional vertical or conical spinning ring 16. Ring engaging part 12 may be in three sections, as shown in FIGS. 1–3 and 6, or may be in two sections, as shown in FIGS. 4 and 5. Ring engaging part 12 is fabricated from a material which has a relatively low coefficient of friction with respect to the metallic spinning ring 16, with desirable wear-resistant properties with respect to the rings. Ring engaging part 12 is typically fabricated from a synthetic material such as nylon, an acetyl resin or some combination of these. While these materials have desirable wear-resistant properties, they are typically good heat insulators.

Yarn engaging part 14 is in general shaped to form an upright loop so that the yarn 18 may be thereby threaded through traveler 10 and engage the traveler in a yarn engaging area 20. Yarn engaging part 14 is generally formed from a rod-shaped stock, such as wire, with a substantially greater length than thickness. The wire is bent into the desired final shape by conventional forming apparatus and can assume any standard traveler shape.

If yarn 18 is abrasive and has a relatively high coefficient of friction with respect to yarn engaging part 14, the combined effects of friction and heat have a tendency to wear or cut the yarn engaging part 14 in yarn engaging area 20. Thus, yarn engaging part 14 is fabricated from a material which has desirable wear-resistant properties with respect to yarn 18, and is typically a metal such as steel.

Figure 3:
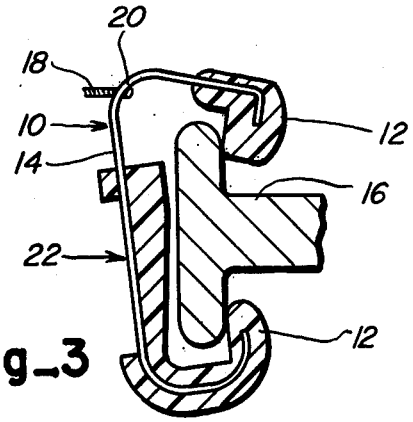
FIG. 3 is a cross-sectional view taken along line 3—3 of FIG. 2, showing a cross-sectional view of a traveler in accordance with the invention in position around a vertical spinning ring.

Referring particularly to FIG. 3, the method by which traveler 10 is made in accordance with the invention can be seen. Ring engaging part 12 and yarn engaging part 14 are generally joined together by conventional, synthetic molding apparatus. The metallic yarn engaging part 14 is placed in a mold (not shown) having the desired final configuration of ring engaging part 12. Ring engaging part 12 is then molded around yarn engaging part 14. According to the invention, yarn engaging part 14 is joined to the bottom portion of ring engaging part 12 so that in the area 22 where the two parts are joined a substantial portion of the surface of the yarn engaging part protrudes above the surface of the ring engaging part and is thereby exposed to the atmosphere.

Figure 2:
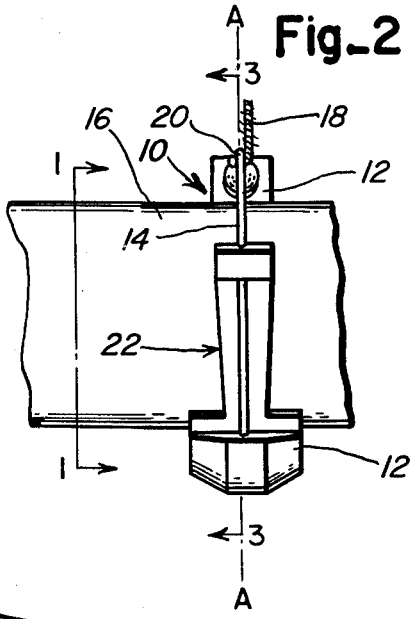
FIG. 2 is an end view of a traveler in accordance with the invention, in spinning position around a vertical spinning ring.

With reference to FIGS. 1 and 2, particularly FIG. 1, yarn is fed from a feed roll, (not shown) positioned on Axis A—A above and to the right of traveler 10, as viewed in FIG. 1. The bobbin, (not shown) around which spun or twisted yarn is wound, is positioned on Axis A—A directly to the right of traveler 10, as viewed in FIG. 1.

In spinning or twisting, the bobbin, (not shown) which is positioned at the center of the circular spinning ring 16, is rapidly rotated about its own axis. Yarn 18, which is threaded through the yarn engaging part 14, is drawn from the overhead feed roll through the traveler 10 and onto the bobbin. As the bobbin rotates and gathers yarn 18, the traveler 10 is rapidly drawn around the ring 16 by the yarn, twisting yarn 18. As yarn 18 is drawn past yarn contacting part 14, the accompanying frictional forces generate heat in yarn contacting area 20. Since yarn contacting part 14 is fabricated from a heat conductive material, heat is conducted away from yarn contacting area 20 and distributed throughout the entire yarn contacting part 14. Heat which is conducted to exposed area 22 is quickly dissipated to the atmosphere, due to the rapid motion of traveler 10 traveling around ring 16 relative to the surrounding air. Thus, a cooling effect is provided, and heat generated at yarn contacting area 20 is dissipated at exposed area 22.

FIGS. 4 and 5 illustrate an additional embodiment of the invention wherein frictional contact is reduced between the yarn and the yarn engaging part 14'. Traveler 10' has a yarn engaging part 14' and a ring engaging part 12' which forms a single, continuous structure. Ring engaging part 12' thus completely encloses a spinning ring on three sides when it is mounted around the ring. Yarn engaging part 14' is formed into an O-shaped loop, extending above the top surface of ring engaging part 12' and mounted so that the face of the loop is perpendicular with respect to the face of the ring engaging part 12'. Yarn engaging area 20' of yarn engaging part 14' is thus perpendicularly oriented toward the center of a spinning ring when traveler 20' is in postion around the ring. Since yarn passes through the loop perpendicular to the face of yarn engaging part 14', the yarn need not bend around part 14'. Frictional contact is thereby reduced between the yarn and yarn engaging area 20'. (Compare yarn 18 in FIG. 1.)

Figure 6:
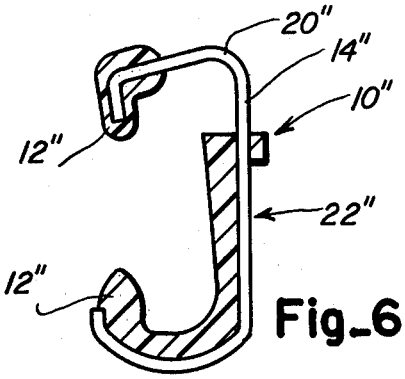
FIG. 6 is a cross-sectional view of a traveler in accordance with the invention illustrating yet another embodiment of the invention.

FIG. 6 illustrates an additional embodiment of the invention wherein a substantial portion of the surface of yarn engaging part 14'' is exposed to the atmosphere over substantially its entire length. Traveler 10'' is fabricated so that, in the area 22'' where yarn engaging part 14'' is joined to the bottom portion of ring engaging part 12'', a substantial portion of the surface of yarn engaging part 14'' is exposed to the atmosphere over substantially its entire length. This increases the cooling effect due to the motion of exposed area 22'' relative to the surrounding air as traveler 10'' travels around the ring.

Figure 7:
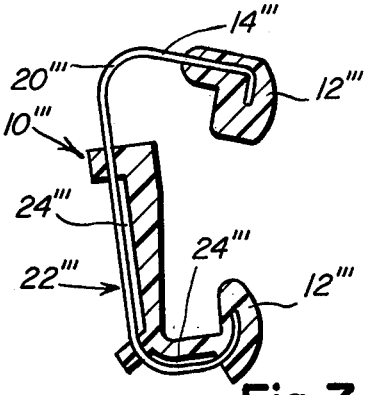
FIG. 7 is a cross-sectional view of a traveler in accordance with the invention illustrating yet another embodiment of the invention.

FIG. 7 illustrates an additional embodiment of the invention wherein a substantial portion of the yarn engaging part 14''' is completely exposed to the atmosphere in the area where the yarn engaging part is joined to the ring engaging part 12'''. Traveler 10''' is fabricated so that one or more cut-out areas 24''' are provided in area 22'''where ring engaging part 12''' is joined to yarn engaging part 14'''. Cut-out areas 24''' thus completely expose a substantial portion of yarn engaging part 14''' to the atmosphere in the area 22''' where the ring engaging part 12''' and yarn engaging part are joined. An additional cooling effect is thereby provided.

Thus, a traveler has been described in which the heat generated by the frictional engagement of the traveler with the yarn is dissipated into the atmosphere thereby cooling the area of the traveler which engages the yarn.

I claim:

1. A traveler for use with a spinning ring having a vertical flange, said traveler having a ring contacting part and a heat conductive yarn contacting part anchored to said ring contacting part, said ring contacting part comprising a single J-shape whose curved portion is adapted to embrace the lower edge of said vertical flange and guide the traveler about the center of said spinning ring, said yarn contacting part having a curved yarn guiding portion extending about the upper edge of said vertical flange and a J-shaped anchor portion, said J-shaped anchor portion being in juxtaposition to said J-shaped ring contacting part on the side facing the center of said ring, said ring contacting part having means extending toward the center of the spinning ring surrounding only a fractional length of the juxtaposed anchor portion of said yarn contacting part leaving directly exposed to air movement the major portion of the length of said anchor portion adjacent to the area of heat generation in the yarn guiding portion of said yarn contacting part said exposed portion of said anchor portion presenting surfaces exposed to air movement at least in the direction which faces the center of the ring and in oppositely facing directions which are mutually perpendicular to the ring center line and a ring diameter to provide maximum dissipation of frictional heat.

2. A traveler as recited in claim 1, wherein the exposed portion of said anchor portion is in contact with the surface of said ring contacting part.

3. A traveler as recited in claim 1, wherein the terminal portion of said anchor portion of said yarn contacting part is embedded in said ring contacting part.

4. A traveler as recited in claim 1, wherein said yarn guiding portion of said yarn contacting part is formed as a ring in a plane perpendicular to a diameter line of the spinning ring.

5. A traveler as recited in claim 1, wherein said means on said ring contacting part surrounds said anchor portion of said yarn contacting part at spaced intervals of its length with the exposed portion thereof being spaced away from said ring contacting part.

6. A traveler as recited in claim 1, wherein the exposed length of said anchor portion comprises a straight portion of said anchor portion.

7. A traveler as recited in claim 1, wherein the exposed portion of said anchor portion is spaced outwardly of the surface of the ring contacting part.

* * * * *